US009814099B2

(12) United States Patent
Lau et al.

(10) Patent No.: US 9,814,099 B2
(45) Date of Patent: Nov. 7, 2017

(54) SUBSTRATE SUPPORT WITH SURFACE FEATURE FOR REDUCED REFLECTION AND MANUFACTURING TECHNIQUES FOR PRODUCING SAME

(71) Applicant: APPLIED MATERIALS, INC., Santa Clara, CA (US)

(72) Inventors: Shu-Kwan Lau, Mountain View, CA (US); Joseph M. Ranish, San Jose, CA (US); Paul Brillhart, Pleasanton, CA (US); Mehmet Tugrul Samir, Mountain View, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 499 days.

(21) Appl. No.: 14/324,557

(22) Filed: Jul. 7, 2014

(65) Prior Publication Data

US 2015/0037017 A1 Feb. 5, 2015

Related U.S. Application Data

(60) Provisional application No. 61/861,956, filed on Aug. 2, 2013.

(51) Int. Cl.
*H05B 3/00* (2006.01)
*F27D 5/00* (2006.01)

(52) U.S. Cl.
CPC ..... *H05B 3/0047* (2013.01); *F27D 5/0037* (2013.01)

(58) Field of Classification Search
None
See application file for complete search history.

(56) References Cited

U.S. PATENT DOCUMENTS 5,926,615 A * 7/1999 Hwu ..... H01L 21/67115 118/724
7,119,337 B1 * 10/2006 Johnson ..... G01J 3/02 250/339.13
8,226,770 B2 7/2012 Sanchez et al.
2002/0003278 A1 1/2002 Benedix
2002/0127508 A1 9/2002 Jin et al.
2003/0205324 A1 * 11/2003 Keeton ..... C23C 16/45521 156/345.5
2004/0151483 A1 * 8/2004 Neyret ..... H01L 21/324 392/416
2004/0187790 A1 9/2004 Bader et al.
(Continued)

FOREIGN PATENT DOCUMENTS

DE 102013009925 A1 * 12/2014 ..... G01J 5/0887

OTHER PUBLICATIONS

International Search Report and Written Opinion dated Oct. 28, 2014 for PCT Application PCT/US2014/045968.

*Primary Examiner* — Joseph M Pelham
(74) *Attorney, Agent, or Firm* — Moser Taboada; Alan Taboada

(57) ABSTRACT

Methods and apparatus are provided for reducing the thermal signal noise in process chambers using a non-contact temperature sensing device to measure the temperature of a component in the process chamber. In some embodiments, a susceptor for supporting a substrate in a process chamber includes a first surface comprising a substrate support surface; and a second surface opposite the first surface, wherein a portion of the second surface comprises a feature to absorb incident radiant energy.

20 Claims, 3 Drawing Sheets

(56) References Cited

U.S. PATENT DOCUMENTS

| | | | | |
|---|---|---|---|---|
| 2005/0223994 | A1* | 10/2005 | Blomiley | C23C 14/505 118/725 |
| 2007/0077355 | A1 | 4/2007 | Chacin et al. | |
| 2010/0055318 | A1 | 3/2010 | Volf et al. | |
| 2013/0276695 | A1* | 10/2013 | Pitney | H01L 21/02104 117/86 |
| 2014/0199056 | A1* | 7/2014 | Chang | H01L 21/67115 392/416 |
| 2014/0261185 | A1* | 9/2014 | Aboagye | C23C 16/4411 118/728 |
| 2014/0263268 | A1* | 9/2014 | Cong | H05B 1/0227 219/392 |
| 2015/0160377 | A1* | 6/2015 | Kuroda | G02B 1/118 428/141 |
| 2015/0368829 | A1* | 12/2015 | Ngo | C30B 25/12 118/500 |
| 2016/0131532 | A1* | 5/2016 | Zernickel | G01J 5/0887 374/121 |

* cited by examiner

FIG. 2A(1)

FIG. 2A(2)
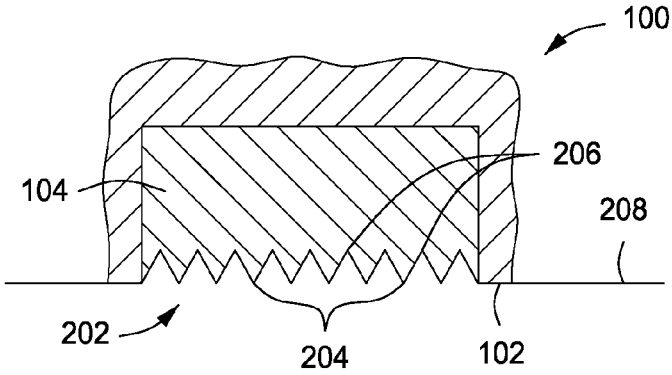
FIG. 2A(3)
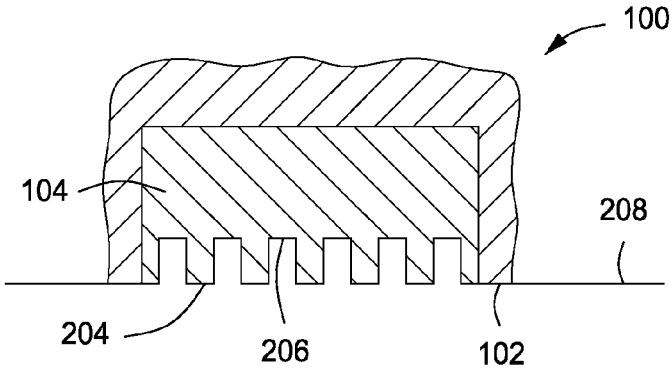
FIG. 2A(4)
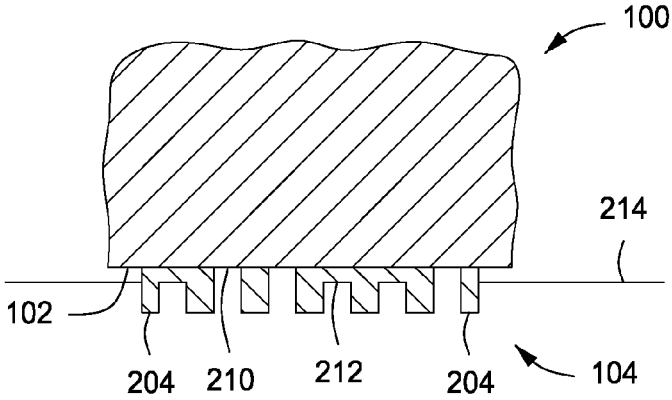
FIG. 2A(5)
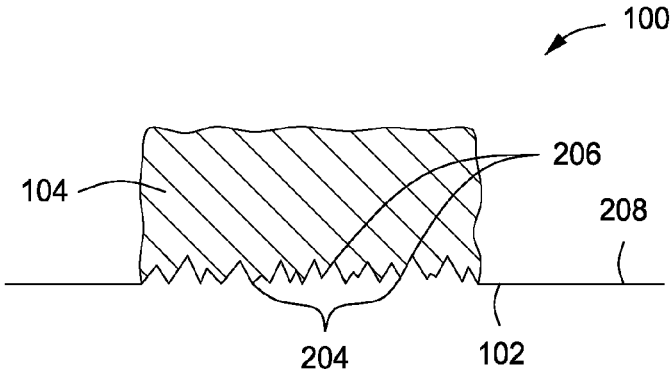

SUBSTRATE SUPPORT WITH SURFACE FEATURE FOR REDUCED REFLECTION AND MANUFACTURING TECHNIQUES FOR PRODUCING SAME

CROSS-REFERENCE TO RELATED APPLICATIONS

This application claims benefit of U.S. provisional patent application Ser. No. 61/861,956, filed Aug. 2, 2013, which is herein incorporated by reference in its entirety.

FIELD

Embodiments of the present invention generally relate to an apparatus for processing substrates.

BACKGROUND

In some process chambers, for example in epitaxial deposition chambers for processing semiconductor substrates, heat sources providing radiant energy, such as halogen lamps, may be used to heat a target element in the chamber. In some cases, the target may be, for example, a susceptor for supporting a substrate. For a variety of reasons, it is often desirable to measure the temperature of the susceptor during processing. In some cases, measuring the temperature of a susceptor cannot be achieved with direct measurement devices such as thermocouples. The temperature can be sensed using remote temperature sensors capable of detecting thermal radiation, for example, pyrometers, to detect a signal emitted by the susceptor that is proportional to the temperature of the susceptor.

The inventors have observed that radiant energy from the heat source may be reflected from the susceptor and received by the temperature sensor in the form of noise, interfering with an accurate measurement of the temperature signal from the susceptor. The noise may decrease the signal to noise ratio and/or provide a signal with a wavelength detectable by the temperature sensor.

Accordingly, the inventors have provided methods and apparatus to improve the measurement of the temperature signal from the target.

SUMMARY

Methods and apparatus are provided for reduced thermal reflection (noise) in process chambers using a non-contact temperature sensing device to measure the temperature of a component in the process chamber. In some embodiments, a susceptor for supporting a substrate in a process chamber includes a first surface comprising a substrate support surface; and a second surface opposite the first surface, wherein a portion of the second surface comprises a feature to absorb incident radiant energy at a wavelength of about 1.0 to about 4.0 micrometers.

In some embodiments, a substrate processing apparatus includes a process chamber having a volume; a susceptor as described herein disposed in the process chamber; a plurality of radiant energy sources to irradiate the second surface with incident radiant energy; and a temperature sensor to detect the temperature of a portion of the second surface, wherein the temperature sensor reads the temperature of the second surface of the susceptor in a location corresponding to the feature, and wherein the feature absorbs more incident energy than a surface of the susceptor without the feature.

In some embodiments, a substrate processing apparatus includes a process chamber having a volume; a susceptor for supporting a substrate disposed within the process chamber, the susceptor comprising: a first surface comprising a substrate support surface; a second surface opposite the first surface; and a feature on the second surface comprising a centrally located ring configured to absorb incident radiant energy. A plurality of radiant energy sources are provided to irradiate the second surface with incident radiant energy. A temperature sensor is provided to detect the temperature of a portion of the second surface comprising the feature, wherein the feature is configured to absorb more incident energy at a wavelength of about 3.0 to about 3.6 micrometers than a surface of the susceptor without the feature.

Other and further embodiments of the present invention are described below.

BRIEF DESCRIPTION OF THE DRAWINGS

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

FIGS. 2A(1)-2A(5) depict enlarged views of a portion 2A of the susceptor of FIG. 1 in accordance with embodiments of the present invention.

Figure 1:
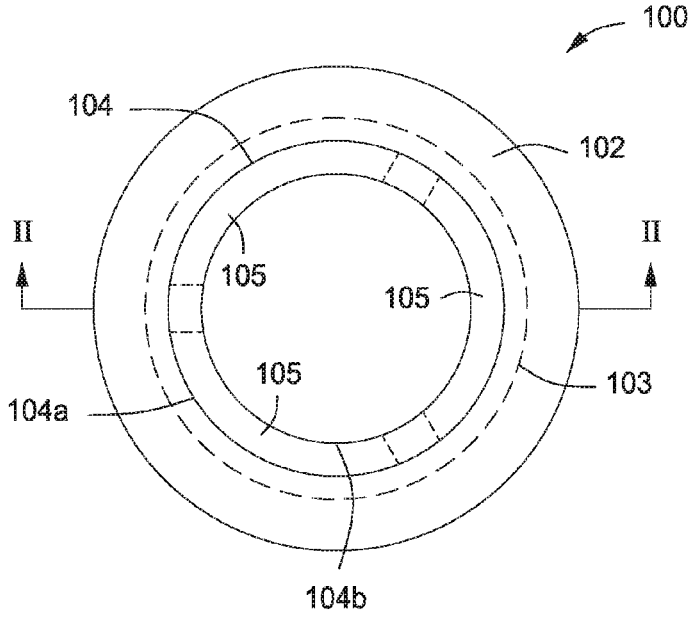
FIG. 1 depicts a bottom view of a susceptor in accordance with embodiments of the present invention.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

Embodiments of the present invention may advantageously enhance the absorption of radiant energy, thereby reducing the amount that is reflected by a portion of a susceptor and received by a temperature sensor, i.e., a pyrometer. Reflected radiant energy that is received by a temperature sensor and interferes with accurate temperature data is sometimes referred to as noise. Embodiments of the present invention provide features on a surface of a susceptor that advantageously enhance the amount of energy absorbed by the feature, thereby reducing the amount of noise received by the temperature sensor.

FIG. 1 depicts a bottom view of a susceptor in accordance with embodiments of the present invention. The susceptor 100 may be fabricated from any process compatible material, such as monolithic silicon carbide (SiC), or may be formed from graphite and coated with SiC. In some embodiments comprising monolithic SiC, the susceptor 100 may be sintered from SiC powder to a net shape (e.g., a final shape), or near net shape and then processed further to a net shape. In some embodiments, the susceptor 100 may be formed from graphite by sintering as above, or by machining from a block of graphite material. Graphite susceptors are sometimes coated with a SiC coating using any suitable method to coat the desired surface.

The susceptor 100 has a first surface 101 (shown in FIG. 2) comprising a substrate support surface 103 (shown in FIG. 2 and in phantom in FIG. 1) configured to support a substrate (such as substrate 325 depicted in FIG. 3) during processing. The susceptor 100 has a second surface 102, opposing the first surface 101, including a feature 104. Feature 104 may be of any shape or pattern. For example, the feature 104 may compromise a centrally located ring bounded by an outer curved edge 104*a* and an inner curved edge 104*b* as illustrated in FIG. 1. More than one ring may also be used. Other shapes may be beneficial in some situations. The feature 104 need not be a continuous structure as illustrated in FIG. 1 (solid lines). The feature 104 may comprise, for example, a plurality of structures 105 mounted to the second surface 102 in a spaced apart fashion (dashed lines). The feature 104 may be formed in the susceptor 100 in any suitable fashion, such as being cast in the susceptor, embossed into the susceptor, machined into the susceptor, by roughening or by treating the second surface of the susceptor, or the like. A coating may also be applied to a portion of the second surface 102 to provide the characteristics of the feature.

The feature 104 is configured to have enhanced energy absorption characteristics as compared to the second surface 102 of the susceptor 100 if the feature 104 was not provided. In some embodiments, the entire second surface 102, or substantially the entire second surface 102, may include the feature 104 as disclosed.

In some embodiments, the enhanced energy absorption of the feature 104 is limited to a wavelength or range of wavelengths. For example, in some embodiments, the feature has enhanced energy absorption over a range of about 0.4 to about 4.0 micrometers, or over a range of about 3.0 to about 3.6 micrometers. In some embodiments, the feature has enhanced energy absorption over a range centered about an operational wavelength of a pyrometer used to detect the temperature of the susceptor 100.

Figure 2:
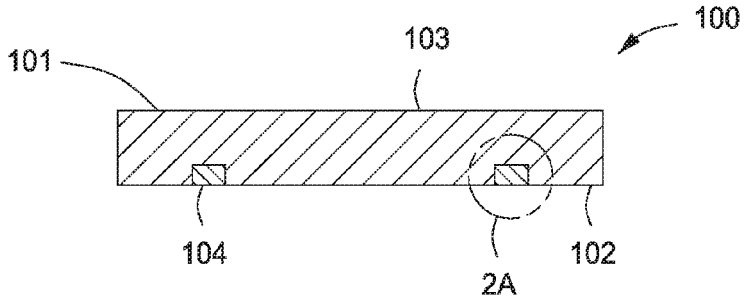
FIG. 2 depicts a side sectional view of the susceptor of FIG. 1 along line II-II.
Figure 2:
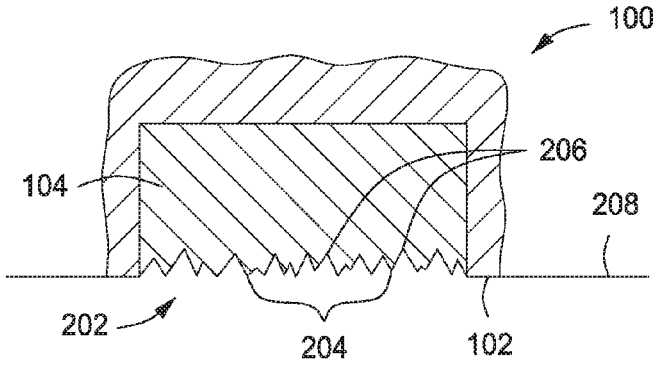

The feature 104 may have a textured surface that may include a random pattern roughness (as depicted in FIG. 2(A)1), or a periodic pattern of structures, such as, in non-limiting examples, grooves or channels (as depicted in FIGS. 2(A)2-2(A)4), cavities, holes, or depressions formed in the second surface 102 partially through a thickness of the susceptor 100. The periodic pattern of structures may be interconnected at the second surface 102 or at a location within the thickness of the susceptor 100. In some embodiments, the periodic pattern of structures comprises a plurality of conic solids with apexes of the conic solids arranged in the same plane, or substantially in the same plane, as illustrated in FIG. 2A(2).

The feature 104 may be a separate component or coating as illustrated in FIGS. 2A(1)-2A(4), or may be a physical alteration or modification of a portion of the second surface 102 as illustrated in FIG. 2A(5). In embodiments in which the feature 104 is a modification of a portion of the second surface 102, the modification may be a random pattern as illustrated in FIG. 2A(5), or may be a uniform pattern, similar to that illustrated in FIGS. 2A(2) and 2A(3).

While not wishing to be bound by theory, the inventors believe that certain surface textures on a body, for example the susceptor 100, increase the effective absorption and decrease the net reflectivity of the body to a desired range of wavelengths. This has been observed to beneficially affect pyrometric temperature reading and improve the radiant heating and cooling of the susceptor 100. Further increases in absorption, or reductions in reflectivity, may be obtained at a certain wavelength or range of wavelengths (e.g., a first wavelength or range of first wavelengths), by providing the characteristic length of the depression or cavity to be a multiple of the wavelength. In addition, providing a depth of the depression or cavity of about three times the wavelength advantageously enhances the suppression of undesired radiation. Beneficial results may also be obtained when the grooves or channels are closely packed to each other, providing the densest distribution of grooves or channels possible consistent with resistance to thermal smoothening. Grooves separated by a wall of about 1 micrometer to about 100 micrometers have been found to be effective in suppressing undesired radiation.

In some embodiments, the feature 104 comprises a roughened surface. The roughened surface, for example a random pattern roughness as in FIG. 2A(5), may be formed by creating a random distribution of high points and low points with respect to a reference plane parallel to the second surface 102 between the mid-plane of the susceptor and the second surface 102. A "high point" as used herein means a point disposed on the side of the reference plane towards free space, i.e., directed outward and away from the second surface 102. A "low point" as used herein means a point disposed on the other side of a reference plane, i.e., towards the mid-plane of the susceptor 100. The reference plane may be a plane corresponding to the original surface.

Low points may be created relative to a reference plane, for example, a plane through the original surface, by selectively removing material from the second surface 102 of the susceptor. The high points may correspond to points lying in the original plane. For example, as illustrated in FIG. 2A(1), feature 104 comprises a roughened surface 202 which includes high points 204 and low points 206 with respect to plane 208.

Alternatively, high and low points may be created by selectively depositing material to portions of the second surface 102 as illustrated in FIG. 2A(4). The high points 204 may correspond to portions of the deposited material extending beyond a reference plane 214. The low points (e.g., 210, 212) may be points receiving no deposited material 210 (i.e., the original second surface 102) or receiving less deposited material 212 than the high points 204.

In some embodiments, the feature 104 comprises a general roughened surface formed by subtractive techniques, such as abrasive blasting using ceramic or metal abrasive media to provide the desired texture. The desired characteristics of the feature 104 formed in such a manner may be controlled by appropriately selecting the media size and shape, the pressure of the stream of media, the angle of impingement, the dwell time, or other process parameters. Desired features may include the number of depressions or holes formed in the surface per unit area, the depth and size (e.g., diameter) of the depressions. The shape or pattern of the feature 104 may be obtained by controlling the stream of media to the desired pattern.

In some embodiments a mask resistant to the blasting media may be provided over the areas not intended to be contacted by the media. Other masking techniques may also be used. The areas to be blasted may be in the general shape of an elongate slot in the mask. Media blasting will remove susceptor material in the un-masked areas, leaving, in a non-limiting example, grooves or channels in the susceptor surface. After blasting the susceptor surface, for example second surface 102, the mask may be removed, leaving the desired pattern in the surface.

In embodiments involving subtractive techniques, such as media blasting on a SiC coated graphite susceptor 100, the depth of the texture may be less than the thickness of the SiC coating, thereby maintaining the integrity of the SiC coating over the graphite. Alternately, a graphite susceptor 100 with an un-coated feature area may be blasted to create a texture in the desired pattern for the feature, followed by coating with SiC. The characteristics of the textured pattern formed on the surface of the susceptor may be adjusted to account for the thickness of the SiC coating.

In some embodiments, the feature 104 may be formed using additive techniques. In some embodiments, a SiC layer is grown on the second surface 102 of the susceptor 100 in desired regions. A selective mask pattern may be applied to the added SiC layer using any method. To achieve the desired characteristics in the feature, the SiC may be etched away using, for example, a photolithography technique. The SiC layer may be applied directly to the graphite susceptor 100 or may be applied to a SiC coating applied to the susceptor 100.

In other embodiments, the feature 104 may be formed from a slurry comprising sacrificial particles and susceptor material particles applied to a portion of the second surface 102 of the susceptor 100 and sintered in place. The sacrificial particles may be polymer-, carbon-, or graphite-containing particles sized and shaped to correspond with the desired cavities or holes to be formed on the second surface 102 of the susceptor 100. In some embodiments the sacrificial particles are spherical or hemispherical in shape. After applying the slurry to the second surface 102 using any appropriate method, the slurry is sintered in place. The sacrificial particles may be removed from the sintered slurry by any method, such as oxidation or selective etching, leaving a feature comprising cavities formed in the approximate shape of the sacrificial particles.

In still other embodiments, ceramic fabrication techniques for forming thin features may be employed to form the desired characteristics in the feature 104. For example, a tape cast process may be used to form the feature on the second surface 102 of the susceptor 100. In a tape cast process a mixture of a polymer carrier and ceramic particles, for example SiC, is formed in a ribbon, or tape, on the desired surface of the susceptor 100. The tape is positioned on the susceptor in the desired configuration and fired in a furnace to burn off the polymer carrier, leaving the ceramic particles with cavities in the regions previously filled with the polymer.

In still other embodiments, the feature 104 can be formed from two immiscible phases of materials, one of which comprises ceramic particles, for example SiC, that are mixed together. The mixture is then applied to a surface of the susceptor 100. When the mixture is heated, the materials self-assemble into domains forming a periodic arrangement of structures and the ceramic particles bond with the susceptor 100.

In still other embodiments, lithographic processes may be used, employing either positive or negative masks and subtractive by etching or additive by selective nucleation and deposition techniques.

Figure 3:
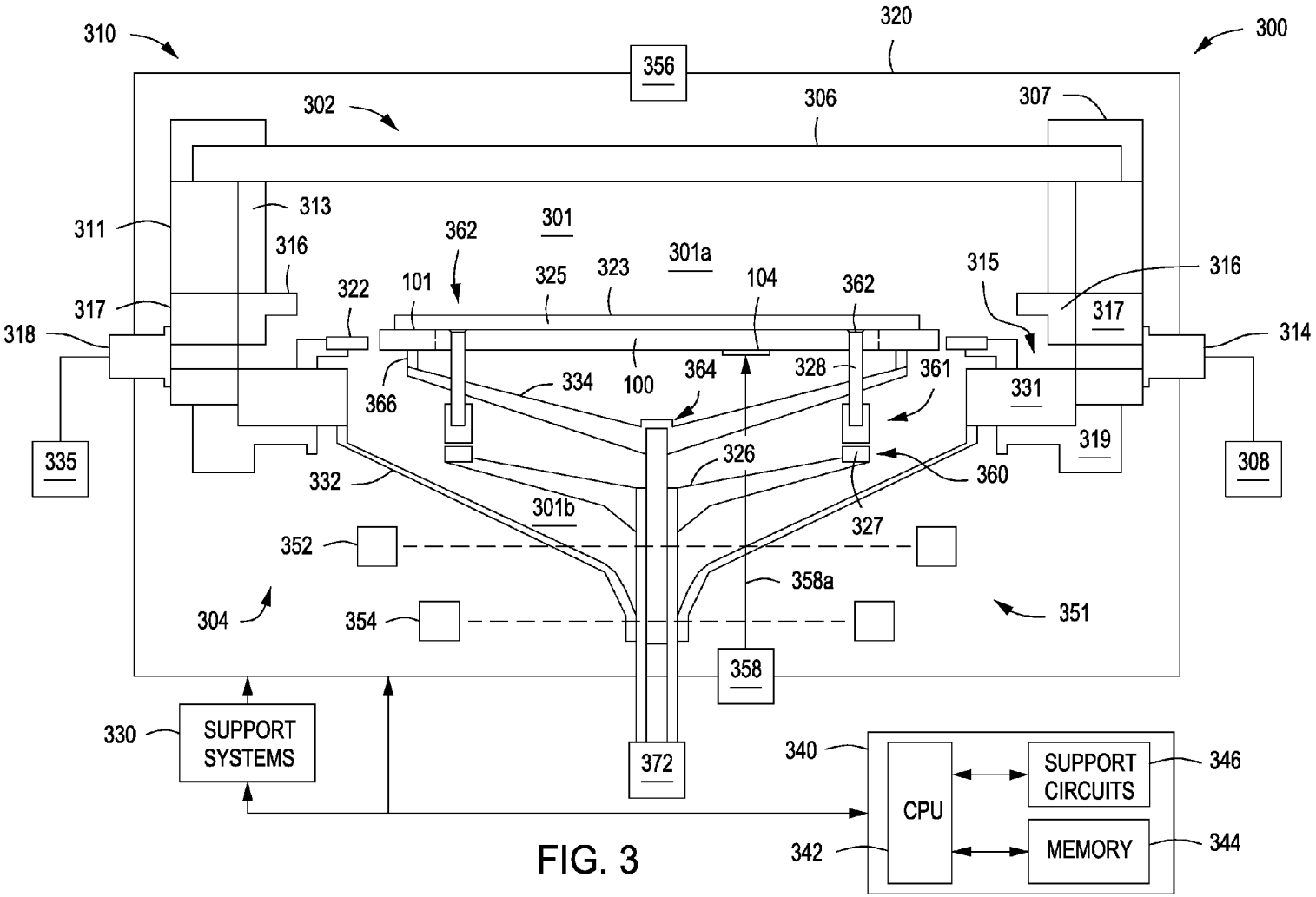
FIG. 3 depicts a schematic side view of a process chamber in accordance with some embodiments of the present invention.

FIG. 3 depicts a schematic side view of a process chamber 300 comprising a process chamber 310 in accordance with some embodiments of the present invention. In some embodiments, the process chamber 310 may be modified from a commercially available process chamber, such as the RP EPI® reactor, available from Applied Materials, Inc. of Santa Clara, Calif., or any other suitable semiconductor process chamber adapted for performing epitaxial silicon deposition processes or chemical vapor deposition (CVD) processes, or other processes employing lamp heated susceptors. The process chamber 300 may be adapted for performing epitaxial deposition processes and illustratively comprises a process chamber 310, a volume 301, a gas inlet port 314, an exhaust manifold 318, and a susceptor 100 separating the volume into a processing volume 301*a* above the first surface 101 and a non-processing volume 301*b* below the first surface 101. The process chamber 300 may further include a controller 340, as discussed in more detail below.

The gas inlet port 314 may be disposed at a first side of a susceptor 100 (e.g., in processing volume 301*a*) disposed inside the process chamber 310 to provide a process gas across a processing surface 323 of a substrate 325 when the substrate 325 is disposed in the susceptor 100. In some embodiments, a plurality of process gases may be provided from the gas inlet port 314. The plurality of process gases may be provided, for example, from a gas panel 308 coupled to the gas inlet port 314. The gas inlet port 314 may be coupled to a space 315, as illustrated in FIG. 3, formed by one or more chamber liners of the processing volume 301 a to provide a process gas across the processing surface 323 of the substrate 325.

The exhaust manifold 318 may be disposed at a second side of the susceptor 100, opposite the gas inlet port 314, to exhaust the process gases from the process chamber 300. The exhaust manifold 318 may include an opening that is about the same width as the diameter of the substrate 325 or larger. The exhaust manifold 318 may be heated, for example, to reduce deposition of materials on surfaces of the exhaust manifold 318. The exhaust manifold 318 may be coupled to a vacuum apparatus 335, such as vacuum pump, abatement system, or the like to exhaust any process gases exiting the process chamber 300.

The process chamber 310 generally includes an upper portion 302, a lower portion 304, and an enclosure 320. The upper portion 302 is disposed on the lower portion 304 and includes a chamber lid 306, an upper chamber liner 316, and a spacer liner 313. In some embodiments, an upper temperature sensor, upper pyrometer 356, may be provided to provide data regarding the temperature of the processing surface of the substrate during processing. A clamp ring 307 may be disposed atop the chamber lid 306 to secure the chamber lid 306. The chamber lid 306 may have any suitable geometry, such as flat (as illustrated) or having a dome-like shape (not shown), or other shapes, such as reverse curve lids are also contemplated. In some embodiments, the chamber lid 306 may comprise a material, such as quartz or the like. Accordingly, the chamber lid 306 may at least partially reflect energy radiated from the substrate 325 and/or from lamps disposed below the susceptor 100.

The spacer liner 313 may be disposed above the upper chamber liner 316 and below the chamber lid 306 as depicted in FIG. 3. The spacer liner 313 may be disposed on an inner surface of a spacer ring 311, where the spacer ring 311 is disposed in the process chamber 310 between the chamber lid 306 and a portion 317 of the process chamber 310 coupled to the gas inlet port 314 and the exhaust manifold 318. The spacer ring 311 may be removable and/or interchangeable with existing chamber hardware. For example, the spacer ring 311 including the spacer liner 313, may be retrofit to existing process chambers by inserting the spacer ring 311 between the chamber lid 306 and the portion 317 of the process chamber 310. In some embodiments, the spacer liner 313 may comprise a material, such as quartz or the like As depicted in FIG. 3, the upper chamber liner 316 may be disposed above the gas inlet port 314 and the exhaust manifold 318 and below the chamber lid 306, as depicted. In some embodiments the upper chamber liner 316 may comprises a material, such as quartz or the like. In some embodiments, the upper chamber liner 316, the chamber lid 306, and a lower chamber liner 331 (discussed below) may be quartz, thereby advantageously providing a quartz envelope surrounding the substrate 325.

The lower portion 304 generally comprises a base plate assembly 319, a lower chamber liner 331, a lower dome 332, a susceptor 100, a pre-heat ring 322, a susceptor lift assembly 360, a susceptor support assembly 364, a heating system 351, and a lower pyrometer 358. The heating system 351 may be disposed below the susceptor 100 to provide heat energy to the susceptor 100 as illustrated in FIG. 3. The heating system 351 may comprise one or more outer lamps 352 and one or more inner lamps 354. The one or more outer lamps 352 and the one or more inner lamps 354 may include an optional shield (not shown) to direct heat energy to a portion of the susceptor 100 and to prevent direct irradiation of the lower pyrometer 358.

The lower pyrometer 358 may be directed to a particular portion of the second surface 102 of the susceptor 100 as illustrated by the arrow 358*a*. The lower pyrometer 358 may be directed to the feature 104 on the second surface 102 of the susceptor 100 as illustrated in FIG. 3. Only one lower pyrometer is illustrated in FIG. 3 although other pyrometers could be employed in this invention, and each may be directed to a feature on the second surface 102 of the susceptor 100.

The lower pyrometer 358 detects thermal radiation emitted by the targeted portion of the susceptor, in this case, feature 104. The lower pyrometer 358 is configured to detect a particular wavelength, or range of wavelengths, of thermal radiation (e.g., the operational wavelength or wavelengths of the pyrometer). For example, in some embodiments, the lower pyrometer 358 detects thermal radiation at wavelengths from about 1.0 to about 4.0 micrometers, for example from about 3.0 to about 3.6 micrometers, although other wavelengths may be used.

The inventors have observed that lamps typically used to provide heat in the form of IR radiation may produce radiation at a wavelength that overlaps the wavelength detected by the pyrometer. For example, some lamps (e.g., outer and inner lamps 352, 354) produce radiant energy in the form of IR radiation at a frequency range of about 0.4 to 4.0 micrometers. The inventors noted that some of the IR radiation emitted by the outer and inner lamps 352, 354 is not absorbed by the susceptor. Instead, some of the IR radiation is reflected off of the susceptor and some of the reflected radiation may be directed to the lower pyrometer 358.

Reflected radiation may be received by the lower pyrometer 358 in addition to the thermal signal emitted by the susceptor 100. In some cases, the reflected radiation interferes with the lower pyrometer 358 detecting the desired thermal signal emitted by the susceptor 100 Reducing the amount of lamp radiation reflected by the susceptor 100 and detected by the lower pyrometer 358 enhances the accuracy of the lower pyrometer 358 in reading the thermal signal emitted by the susceptor.

In some cases, at least some of the reflected radiation is at a wavelength detectable by the lower pyrometer 358. Radiation received by the pyrometer at the wavelength read by the pyrometer may contribute to a false reading of the thermal signal emitted by the susceptor 100.

Thus, radiation reflected by the susceptor 100 adversely affects the accuracy and repeatability of the lower pyrometer 358 readings. The present invention provides a feature 104 on the susceptor 100 to increase the absorption of the incident thermal radiation provided by the heating system 351, thereby enhancing the emissivity of at least a portion of the susceptor 100. As used herein, the term "incident" refers to radiation arriving at or striking a surface.

In some embodiments, the feature is configured to have enhanced absorption of incident radiant energy at the wavelength, or range of wavelengths, produced by the outer and inner lamps 352, 354. By enhancing the absorption of all wavelengths of incident radiation from the outer and inner lamps 352, 354, the feature 104 reduces background reflected radiation, or noise, as well as reducing the amount of reflected radiation at the wavelength, or wavelengths, detected by the lower pyrometer 358, beneficially affecting the accuracy of the pyrometer readings. Increased absorption of all wavelengths of incident radiant energy also has the benefit of increasing the efficiency of the heating system 351 by decreasing the amount of energy reflected.

Alternately, the feature 104 may be configured to enhance the absorption of incident radiation at the wavelength, or range of wavelengths, detected by the lower pyrometer 358. For example, in some embodiments, the feature may be configured to have greater absorption of incident radiation at wavelengths from about 1.0 to about 4.0 micrometers, for example about 3.0 to about 3.6 micrometers, than the second surface 102 of the susceptor 100 without the feature 104. Such a scheme would reduce, or eliminate, radiation reflected by the feature 104 that could be detected by the lower pyrometer 358, thus increasing the accuracy of the thermal signal emitted by the feature 104.

The feature 104 may be formed on at least a portion of the susceptor 100, for example the portion of the susceptor 100 viewed by the lower pyrometer 358. By providing the feature 104 on the portion of the susceptor 100 viewed by the lower pyrometer 358, reflection of the specific pyrometer wavelength, or range of wavelengths, detected by the lower pyrometer 358 is reduced. Thus the accuracy and repeatability of the pyrometer readings is improved.

In some embodiments, the portion of the susceptor viewed by the pyrometer may comprise the feature 104 alone, or may include the feature as well as an adjacent portion or portions of the second surface 102 without the feature 104. In some embodiments, the feature 104 may be formed on any portion, or portions, of a structure, for example the susceptor 100, or on any portion, or portions, of a surface of a structure, for example second surface 102.

Although the term "ring" is used to describe certain components of the process chamber, such as the pre-heat ring 322, it is contemplated that the shape of these components need not be circular and may include any shape, including but not limited to, rectangles, polygons, ovals, and the like. The lower chamber liner 331 may be disposed below the gas inlet port 314 and the exhaust manifold 318, for example, and above the base plate assembly 319. The gas inlet port 314 and the exhaust manifold 318 are generally disposed between the upper portion 302 and the lower portion 304 and may be coupled to either or both of the upper portion 302 and the lower portion 304.

As illustrated in FIG. 3, the gas inlet port 314 and exhaust manifold 318 may be coupled to the processing volume 301*a* via respective openings in the portion 317 of the process chamber 310. For example, in some embodiments, the space 315 may be at least partially formed by the upper and lower chamber liners 316, 331 on the first side of the susceptor 100. The gas inlet port 314 may be fluidly coupled to the processing volume 301*a* via the space 315.

The susceptor 100 may include any suitable substrate support surface 103, such as a plate (illustrated in FIG. 3) or ring (illustrated by dotted lines in FIG. 3) to support the substrate 325 thereon. The susceptor support assembly 364 generally includes a support bracket 334 having a plurality of support pins 366 to couple the support bracket 334 to the susceptor 100. The susceptor lift assembly 360 comprises a susceptor lift shaft 326 and a plurality of lift pin modules 361 selectively resting on respective pads 327 of the susceptor lift shaft 326. In one embodiment, a lift pin module 361 comprises an optional upper portion of the lift pin 328 that is movably disposed through a first opening 362 in the susceptor 100. In operation, the susceptor lift shaft 326 is moved to engage the lift pins 328. When engaged, the lift pins 328 may raise the substrate 325 above the susceptor 100 or lower the substrate 325 onto the susceptor 100.

The susceptor 100 may further include a lift mechanism 372 coupled to the susceptor support assembly 364. The lift mechanism 372 can be utilized to move the susceptor 100 in a direction perpendicular to the processing surface 323 of the substrate 325. For example, the lift mechanism 372 may be used to position the susceptor 100 relative to the gas inlet port 314. In operation, the lift mechanism may facilitate dynamic control of the position of the substrate 325 with respect to the flow field created by the gas inlet port 314. Dynamic control of the substrate 325 position may be used to optimize exposure of the processing surface 323 of the substrate 325 to the flow field to optimize deposition uniformity and/or composition and minimize residue formation on the processing surface 323. In some embodiments, the lift mechanism 372 may be configured to rotate the susceptor 100 about a central axis of the susceptor 100. Alternatively, a separate rotation mechanism may be provided.

During processing, the substrate 325 is disposed on the susceptor 100. The outer and inner lamps 352 and 354 are sources of infrared (IR) radiation (i.e., heat) and, in operation, generate a pre-determined temperature distribution across the substrate 325 in conjunction with the upper pyrometer 356, the lower pyrometer 358, and the controller 340. The chamber lid 306, the upper chamber liner 316, and the lower dome 332 may be formed from quartz as discussed above; however, other IR-transparent and process compatible materials may also be used to form these components. The outer and inner lamps 352, 354 may be part of a multi-zone lamp heating apparatus to provide thermal uniformity to the backside of the susceptor 100. For example, the heating system 351 may include a plurality of heating zones, where each heating zone includes a plurality of lamps. For example, the one or more outer lamps 352 may be a first heating zone and the one or more inner lamps 354 may be a second heating zone. The outer and inner lamps 352, 354 may provide a wide thermal range of about 200 to about 1300 degrees Celsius, for example from about 300 to about 700 degrees Celsius on the processing surface 323 of the substrate 325. The outer and inner lamps 352, 354 may provide a fast response control of about 0.1 to about 10 degrees Celsius per second on the processing surface 323 of the substrate 325, when disposed on the susceptor 100. In some embodiments, where the substrate is supported, for example, by edge rings or by pins, the heating rates could be about 200 degrees Celsius per second on the processing surface 323. For example, the thermal range and fast response control of the outer and inner lamps 352, 354 may provide deposition uniformity on the substrate 325. Further, the lower dome 332 may be temperature controlled, for example, by active cooling, window design or the like, to further aid control of thermal uniformity on the backside of the susceptor 100, and/or on the processing surface 323 of the substrate 325.

The processing volume 301*a* may be formed or defined by a plurality of chamber components. For example, such chamber components may include one or more of the chamber lid 306, the spacer liner 313, the upper chamber liner 316, the lower chamber liner 331, and the susceptor 324. The processing volume 301*a* may include interior surfaces comprising quartz, such as the surfaces of any one or more of the chamber components that form the processing volume 301*a*. In some embodiments, other materials compatible with the processing environment may be used, such as silicon carbide (SiC) or SiC coated graphite for the susceptor 100. The processing volume 301*a* may accommodate any suitably sized substrate, for example, such as 200 mm, 300 mm, 450 mm, or the like. For example, in some embodiments, if the substrate 325 is about 300 mm, then the interior surfaces, for example of the upper and lower chamber liners 316, 331 may be, in a non-limiting example, about 50 mm to about 100 mm radially away from the edge of the substrate 325. For example, in some embodiments, the processing surface 323 of the substrate 325 may be disposed at up to about 100 mm, or about 20 mm to about 100 mm, vertically from the chamber lid 306.

The processing volume 301*a* may have a varying volume, for example, the size of the volume 301 may shrink when the lift mechanism 372 raises the susceptor 100 closer to the chamber lid 306 and expand when the lift mechanism 372 lowers the susceptor 100 away from the chamber lid 306. The processing volume 301*a* may be cooled by one or more active or passive cooling components. For example, the volume 301 may be passively cooled by the walls of the process chamber 300, which for example, may be stainless steel or the like. For example, either separately or in combination with passive cooling, the volume 301 may be actively cooled, for example, by flowing a coolant about the process chamber 300. For example, the coolant may be a gas or fluid.

The controller 340 may be coupled to various components of the process chamber 300 to control the operation thereof—for example, including the gas panel 308 and the actuator 330. The controller 340 includes a central processing unit (CPU) 342, a memory 344, and support circuits 346. The controller 340 may control the process chamber 300 and various components thereof, such as the actuator 330, directly (as shown in FIG. 3) or, alternatively, via computers (or controllers) associated with the process chamber. The controller 340 may be one of any form of general-purpose computer processor that can be used in an industrial setting for controlling various chambers and sub-processors. The memory, or computer-readable medium, 344 may be one or more of readily available memory such as random access memory (RAM), read only memory (ROM), floppy disk, hard disk, optical storage media (e.g., compact disc or digital video disc), flash drive, or any other form of digital storage, local or remote. The support circuits 346 are coupled to the CPU 342 for supporting the processor in a conventional manner. These circuits include cache, power supplies, clock circuits, input/output circuitry and subsystems, and the like. Inventive methods as described herein may be stored in the memory 344 as software routine that may be executed or invoked to control the operation of the process chamber 300 in the manner described herein. The software routine may also be stored and/or executed by a second CPU (not shown) that is remotely located from the hardware being controlled by the CPU 342.

The above description has been specifically directed to a susceptor comprising a feature on the second surface configured to absorb more incident energy than a portion of the second surface without the feature. However, the feature may be included on any surface of the susceptor or other components within the process chamber for which temperature readings are desired.

While the foregoing is directed to embodiments of the present invention, other and further embodiments of the invention may be devised without departing from the basic scope thereof.

The invention claimed is:

1. A susceptor for supporting a substrate in a process chamber, comprising:

a first surface comprising a substrate support surface; and a second surface opposite the first surface, wherein a portion of the second surface comprises a feature having a plurality of spaced apart structures to absorb incident radiant energy at a wavelength of about 1.0 micrometer to about 4.0 micrometers.

2. The susceptor of claim 1, wherein the feature includes a textured surface.

3. The susceptor of claim 2, wherein the textured surface comprises a random distribution of high points and low points.

4. The susceptor of claim 2, wherein the textured surface comprises a periodic pattern of structures.

5. The susceptor of claim 4, wherein the periodic pattern of structures comprises a plurality of conic solids with apexes of the conic solids disposed substantially in the same plane.

6. The susceptor of claim 1, wherein the feature comprises a plurality of holes in the second surface partially through a thickness of the susceptor.

7. The susceptor of claim 1, wherein the susceptor comprises monolithic silicon carbide or graphite coated with silicon carbide.

8. The susceptor of claim 1, wherein the feature comprises a plurality of structures arranged in at least one ring centered on the second surface.

9. The susceptor of claim 1, wherein the feature is configured to absorb incident radiant energy at a wavelength of about 3.0 to about 3.6 micrometers.

10. A substrate processing apparatus, comprising:

a process chamber having a volume;

the susceptor of claim 1 disposed in the process chamber;

a plurality of radiant energy sources to irradiate the second surface with incident radiant energy; and a temperature sensor to detect the temperature of a portion of the second surface, wherein the temperature sensor reads the temperature of the second surface of the susceptor in a location corresponding to the feature, and wherein the feature absorbs more incident energy than a surface of the susceptor without the feature.

11. The substrate processing apparatus of claim 10, wherein the feature absorbs incident energy at a wavelength about equal to an operational wavelength of the temperature sensor.

12. The substrate processing apparatus of claim 10, wherein at least some of the second surface does not include the feature.

13. The substrate processing apparatus of claim 10, wherein the feature comprises a textured surface.

14. The substrate processing apparatus of claim 13, wherein a textured surface comprises a random distribution of high points and low points.

15. The substrate processing apparatus of claim 13, wherein a textured surface comprises a periodic pattern of structures.

16. The substrate processing apparatus of claim 15, wherein the periodic pattern of structures comprises a plurality of conic solids with apexes of the conic solids disposed substantially in the same plane.

17. The substrate processing apparatus of claim 10, wherein the feature comprises a plurality of holes in the second surface.

18. The substrate processing apparatus of claim 10, wherein the susceptor comprises monolithic silicon carbide or graphite coated with silicon carbide.

19. The substrate processing apparatus of claim 10, wherein the feature comprises a plurality of structures arranged in at least one ring centered on the second surface.

20. A substrate processing apparatus, comprising:

a process chamber having a volume;

a susceptor to support a substrate disposed within the process chamber, the susceptor comprising:

a first surface comprising a substrate support surface;

a second surface opposite the first surface; and a feature centered on the second surface comprising a plurality of spaced apart structures arranged in a ring and configured to absorb incident radiant energy;

a plurality of radiant energy sources to irradiate the second surface with incident radiant energy; and a temperature sensor to detect the temperature of a portion of the second surface comprising the feature, wherein the feature is configured to absorb more incident energy at a wavelength of about 3.0 to about 3.6 micrometers than a surface of the susceptor without the feature.

* * * * *